United States Patent [19]

Fore

[11] 4,427,553

[45] Jan. 24, 1984

[54] REMOVAL OF SOLIDS FROM A COOLING TOWER BASIN

[75] Inventor: Sharon R. Fore, Old Ocean, Tex.

[73] Assignee: Phillips Petroleum Company, Bartlesville, Okla.

[21] Appl. No.: 424,800

[22] Filed: Sep. 27, 1982

Related U.S. Application Data

[62] Division of Ser. No. 285,701, Jul. 22, 1981, Pat. No. 4,389,351.

[51] Int. Cl.[3] ..... B01D 47/00

[52] U.S. Cl. ..... 210/743; 210/745; 210/96.1; 261/3; 261/DIG. 11; 55/228; 55/85; 134/22.18

[58] Field of Search ..... 261/3, DIG. 11; 210/96.1, 803, 534, 523, 525, 319, 743, 745; 55/228, 85; 134/22.18

[56] References Cited

U.S. PATENT DOCUMENTS

| | | | |
|---|---|---|---|
| 1,444,246 | 2/1923 | Hempel | 210/535 |
| 1,999,589 | 4/1935 | Frey | 55/238 |
| 3,860,018 | 1/1975 | Reiter | 134/22.18 |
| 4,306,967 | 12/1981 | Trautwein | 261/DIG. 11 |
| 4,389,351 | 6/1983 | O'Brien | 55/85 |

FOREIGN PATENT DOCUMENTS

| | | | |
|---|---|---|---|
| H 15004 | 3/1956 | Fed. Rep. of Germany | 210/96.1 |
| 2329392 | 1/1975 | Fed. Rep. of Germany | 210/96.1 |

*Primary Examiner*—Bernard Nozick

[57] ABSTRACT

Solids are removed from a cooling tower basin by using a perforated removal header in the basin in conjunction with a back flush flow.

11 Claims, 5 Drawing Figures

REMOVAL OF SOLIDS FROM A COOLING TOWER BASIN

This application is a division of application Ser. No. 285,701, filed July 22, 1981 now U.S. Pat. No. 4,389,351.

This invention relates to the removal of substances from a cooling tower basin. In one aspect, this invention relates to the controlled removal of insoluble solids from a cooling tower basin. In another aspect, this invention relates to the removal of solids from cooled water used with heat exchanger equipment to reduce fouling of such equipment.

BACKGROUND OF THE INVENTION

It is conventional to feed warm water to the top of a cooling tower and cool the water by air as it passes through the tower. The cooled water is collected in a basin at the bottom of the tower for later use with heat exchange equipment. Frequently the warm water feed contains contaminants such as reaction by-products, soluble and insoluble polymeric compounds, etc. Some contaminants precipitate out of the cooled water and settle in the cooling tower basin. If the contaminants are not removed from the basin, they build up to an unsatisfactory level. Unremoved contaminants entrained in cooled water withdrawn from the basin will foul heat exchange equipment using the cooled water. Fouled heat exchange equipment will have to be taken out of use, disassembled, and cleaned. This results in delay, loss of equipment efficiency and increased maintenance costs.

Various techniques have been employed to remove solids that buildup along the bottom of reservoirs, such as cooling tower basins. U.S. Pat. No. 2,179,249 exemplifies a technique wherein a reservoir is fitted with a perforated pipe system which drains the reservoir extremities. Such designs are inadequate in that solids buildup, block the entrances to the drainage pipes, and prevent removal of substances in the reservoirs.

THE INVENTION

It is thus one object of this invention to provide a cooling tower basin solids removal system having reduced blockage problems.

Another object of this invention is to provide a control system which minimizes the amount of undesired solids in a cooling tower basin.

A still further object of this invention is to reduce heat exchange equipment fouling by effectively removing solids from cooled water used with such equipment.

These and other objects, advantages, details, features, and embodiments of this invention will become apparent to those skilled in the art from the following description of the invention, the appended claims, and the drawings in which, FIG. 1 shows a cooling tower system utilizing a perforated back flush and removal header of this invention.

Figure 1:
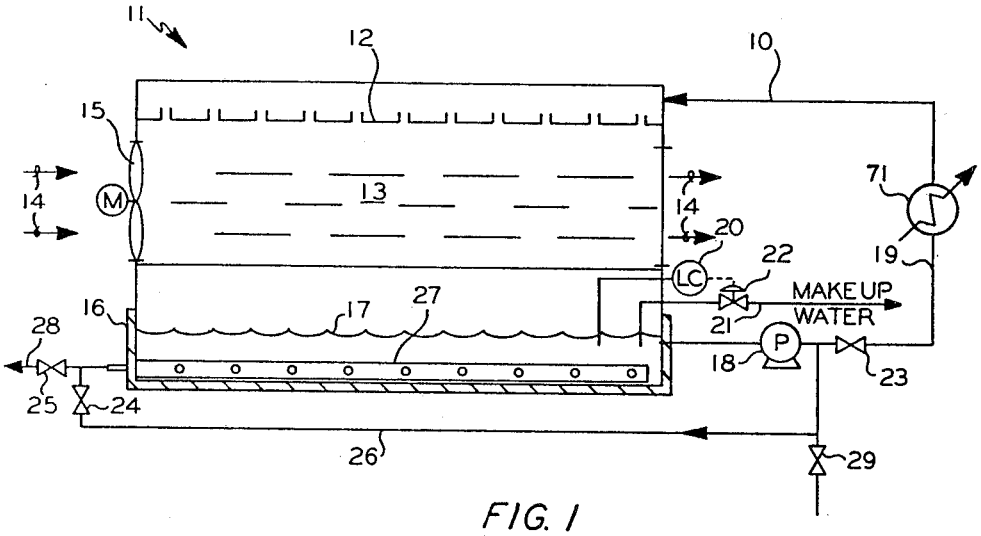

In accordance with this invention, the removal of substances from a cooling tower basin is enhanced by the use of a perforated removal header in conjunction with a back flush flow of an aqueous flush field. Furthermore, a perforated removal header and a backflush flow can be used to control the amount of solids in a cooling tower basin. The heat exchange equipment fouling is reduced by using a perforated removal header and back flush flow to remove solids from cooling tower basins.

More specifically, in accordance with a first embodiment of this invention, a perforated tube header adds a back flush flow into a cooling tower basin and removes solids along with some water. Flush or back flush flow is called such since it is added to the tube header, etc. to unblock the entrances to the tube header, etc. so that a free drainage flow of water and solids occurs. The tube header is preferably a manifold in to which other tubes open. The tube header has connecting branches or arms of perforated tubes which extend into the extremities of the basin. A flow of aqueous flush fluid through the perforated tube header and branches and into the basin agitates and stirs up solids along the basin floor. A mixture of stirred solids and water is then withdrawn from the basin through the perforated tube header and branches.

In one variation of this embodiment, a slow, gentle back flush flow is used to lift the solids from the basin floor. The solids are not mixed with an excessively large amount of the basin water, and only a limited amount of the basin water is withdrawn along with the solids.

In accordance with another embodiment of this invention, two separate perforated tube means are used. Preferably one header is for back flush, and another header is for removal. The flush flow added to the basin via the flush header agitates and sweeps solids along the basin floor toward the removal header which withdraws solids along with some water. Both headers preferably have branches which extend into the basin extremeties. In one variation of this embodiment, the apertures of the perforated back flush header are fitted with spray nozzles which concentrate and direct aqueous flush fluid flow is such manner that solids agitation is at an optimum level. Also, flush flow can thereby be added to the removal header to unblock the fluid entrance to it prior to its use for drainage of substances from the basin.

In accordance still another embodiment of this invention, a sloped basin floor is used in conjunction with a perforated removal header and back flush flow. The floor of the cooling tower basin advantageously is sloped so that solids agitated by the back flush will tend to flow or gravitate toward a low point where they are concentrated for easier removal. The main body of the perforated header can be located in a low point of the cooling tower basin. The branches of the perforated header can extend across the basin and attach to the main body of the header at angles which match the basin floor slope. In one variation of this embodiment, the basin floor is sloped continuously from one side of the basin to the other. The floor is inclined at an angle in the range of about 1° to about 45° from horizontal. A single back flush and removal perforated header is positioned near the low point of the basin created by the sloped floor. The header branches are attached to the main header body at an angle which matches the basin floor incline angle. The back flush is fed into the header to agitate the solids. The back flush flow is then stopped and the water-solids mixture is withdrawn. In a preferred variation of this embodiment a back flush header is positioned near the highest part of the basin floor and a combined back flush-removal header is positioned near the low point. Fluid is fed into the lower, combined header to agitate solids that may have settled near it and may block drainage. Flow in the upper flush header sweeps solids along the inclined floor toward the removal header. Flush flow into the removal header is stopped, and a solids-water mixture is withdrawn through the removal header. In a more preferred variation of this embodiment, the basin floor is sloped from a point near each side of the basin toward a point near the center of the basin. Both portions of the floor are inclined at an angle in the range of about 1° to about 45° from horizontal. The main bodies of a back flush and of a separate removal header are positioned near the center, low point of the basin floor. Branches of the headers extend across the floor at angles matching the floor slopes. Flush flow is fed into the back flush header to agitate solids, and simultaneously a water-solids mixture is withdrawn through the removal header.

In accordance with still another embodiment of the invention the level of solids in a cooling tower basin is controlled by adjusting a quality parameter of the effluent cooled water that is used in the heat exchange equipment. A water parameter such as pH, conductivity, turbidity, etc. is measured by the use of conventional techniques. These measurements indicate the relative concentration of solids in the effluent cooled water stream. Solids are withdrawn from the basin using the back flush flow and removal header until the parameter value is at a desired or acceptable level. In one variation of this embodiment, the parameter is adjusted by manually flushing and agitating solids in the basin and withdrawing the solids-water through a combined back flush-removal header. In a preferred variation of this embodiment, the water parameter measurement is directed to a first automatic controller that manipulates the set point or output of a second controller which adjusts a valve controlling the amount of water and solids withdrawn from the basin through a removal header. The first controller also manipulates the set point or output of a third controller which adjusts a valve controlling the amount of flow into a back flush header. The controllers used herein can be conventional, e.g. proportional-integral-derivative-controllers. They may be analog controllers or programmable digital units. The suction of a pump is connected to the removal header. The pump discharge is directed to the pump suction section, to the back flush header, and to a drain conduit which directs the withdrawn water-solids mixture out of the system. The pump discharge line that feeds the pump suction contains a valve and a controller which controls the pump discharge pressure. In this variation, the desired cooled water parameter is automatically controlled to the desired level by cooperation of the measuring device, controllers, valves and back flush and removal headers.

The following description contains further preferred embodiments of this invention but should not be read in an unduly limiting manner.

FIG. 1 shows a hot feed flow 10 entering a water cooling tower system 11. The feed flow 10 contains contaminants such as entrained sediment, soluble and insoluble polymer, metallic and nonmetallic scale, etc. The water passes to a distributing chamber 12 and is directed over a fill 13 typically consisting of vanes, slats or fins usually made of wood or metal. As the water gravitates over the fill 13, it is cooled by air 14 from a fan 15 directed across the fill 13. The cooled water collects in a basin 16 and is withdrawn by pump 18 via conduit 19 and directed to its intended use, e.g. for cooling in a heat exchanger 71. After the cooled water has picked up heat during its use, it is recycled to the cooling tower system 11 as hot feed flow 10. Substances, such as solids, tend to settle out and accumulate along the basin 16 bottom. Desired basin level 17 is maintained by a level controller 20 which senses basin level 17 and adds makeup water via a conduit 21 through an automatic valve 22. If valve 24 is closed and valve 29 is open then water is removed from the system as blowdown. If valves 23 and 25 are closed and valve 24 is open, the pump 18 discharge is directed through a conduit 26 to a perforated header 27. Solids heat have accumulated along the bottom of the basin 16 are agitated by the action of a flow of the aqueous flush fluid exiting the perforated header 27. After the solids are so agitated, valves 23 and 25 are opened and valve 24 is closed. Solids now thoroughly admixed with the water in the basin 16 are withdrawn via conduit 28 along with some water.

Figure 2:
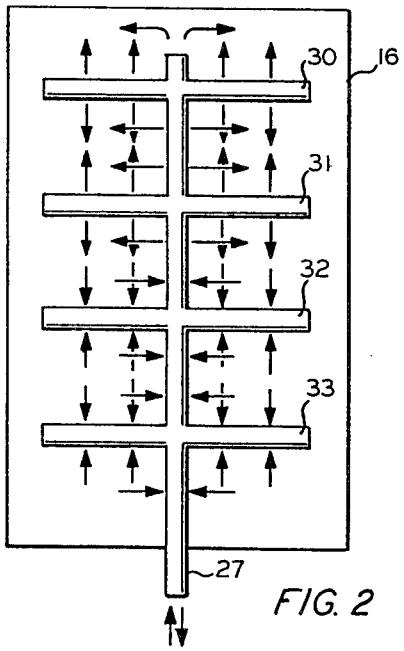
FIG. 2 shows of a top view of cooling tower basin containing a perforated back flush and removal header of this invention.

FIG. 2 shows a top view of one embodiment of a liquid flush and solids removal header 27 of this invention. The header 27 has arms or branches 30, 31, 32 and 33 which extend across the basin 16. The arrows show flow patterns from fluid emitted from perforations in the header body and branches. Branches 30, and 31 show typical flow patterns when used for flush to gently stir up solids along the base 16 bottom. Branches 32 and 33 show flow patterns when used for fluid and solids removal. The size and number of arms and perforations, and the location of such vary with the size of the basin and the nature of the particular matter to be removed. For instance, relatively large perforations are preferred for large particulate matter. The perforations however need not all be the same size.

Figure 3:
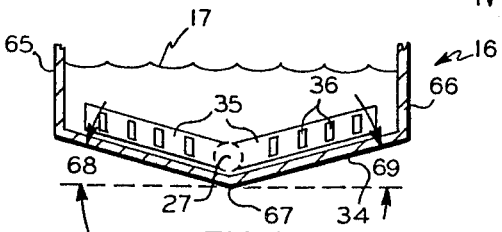
FIG. 3 shows an end view of a cooling tower basin of this invention utilizing a sloped basin floor in conjunction with a back flush and removal header.

FIG. 3 is an embodiment of one end view of a solids removal and liquid flush header of this invention. The header 27 is below the liquid level 17 in the basin 16. The basin floor 34 is sloped from the basin sides 65 and 66 toward the basin center 67. The branches 35 of the header 27 are adapted to match the sloped floor 34. Generally the angles 68 and 69 of the floor slope range from about 1° to about 45°. In this embodiment perforations 36 are rectangularly shaped. Rectangular or square shaped perforations are here selected for ease of manufacture. Circular or other shaped perforations also can be used in embodiments of this invention.

Figure 4:
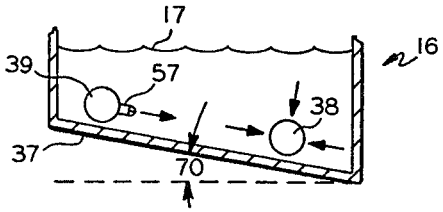
FIG. 4 shows an end view of a cooling tower basin of this invention utilizing a sloped basin floor in conjunction with separate back flush and removal headers.

FIG. 4 is an embodiment of another end view of a different solids removal and liquid flush header. Above the sloped floor 37 of basin 16, the liquid forms a level 17. A perforated removal header 38 is located near the deep portion of the basin 16 near the low point of the sloped floor 37. The removal header 38 can also be fed a back flush flow to agitate and stir up settled solids which block its drainage opening. A separate perforated flush header 39 is located in the shallow portion of the basin 16. The flush header 39 can be fitted with nozzles 57 designed to gently direct fluid along the basin floor 37. This provides a sweeping motion which agitates and guides particulate matter along the basin floor 37 toward the removal header 38. Both the flush header 39 and the removal header 38 may have various arms, perforations, etc. as required by the nature of the fluid and settled or entrained substances. The angle 70 of the slope of the basin floor 37 is in the range of about 1° to about 45°. The slope of the basin floor 37 may be varied to achieve an optimum removal.

Figure 5:
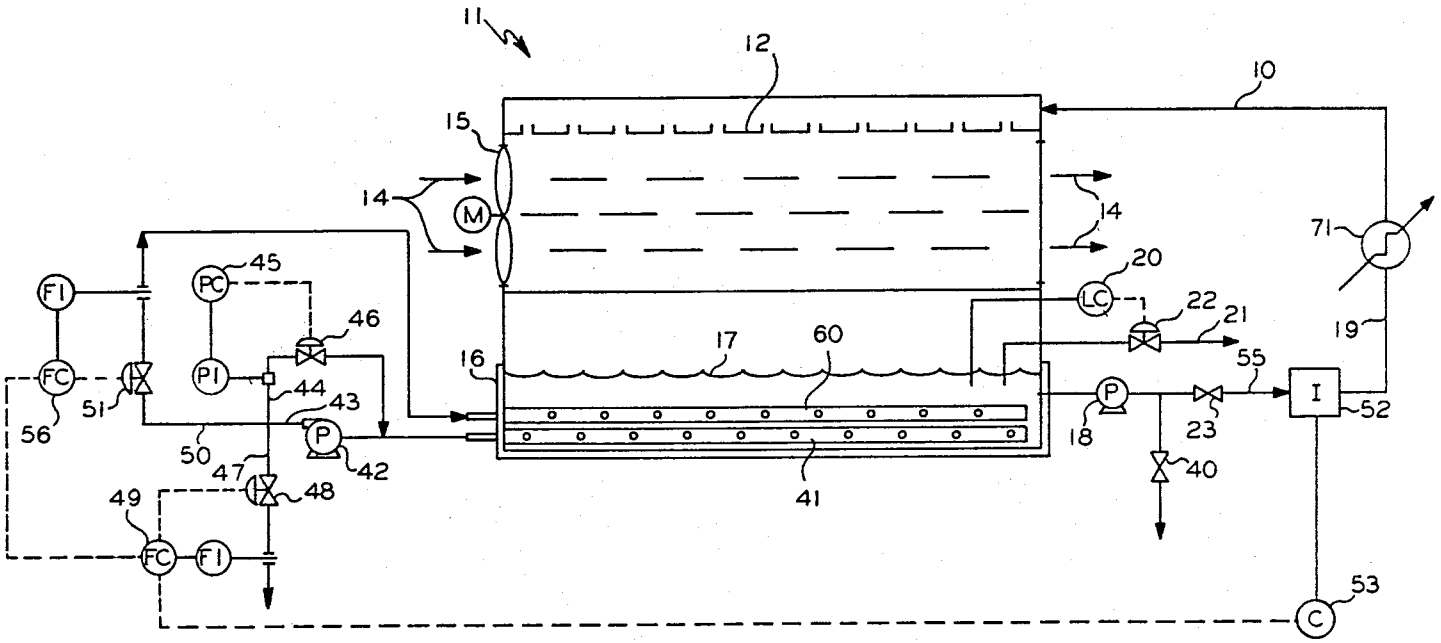
FIG. 5 shows a cooling tower water parameter control system of the present invention utilizing a cooled water parameter measurement device and controllers in conjunction with separate back flush and removal headers.

FIG. 5 is an embodiment of this invention showing the use of perforated flush and removal headers in the control of cooling tower parameters. A hot water feed 10 passes through a cooling tower system 11 and leaves basin 16 as cooled water via 19 after passing through a distribution means 12 over a fill 13 and contacting air 14 from a fan 15. The cooled water in conduit 19 is directed to a heat exchange use 71 and is recyled to the cooling tower system 11 as hot water feed 10. Basin level 17 is maintained by adding makeup water 21 through a control valve 22 adjusted by a level controller 20. When valve 40 is opened and valve 23 is throttled or closed, cooled water from the basin 16 is pumped by pump 18 out of the system as blowdown. The perforated removal header 41 in the basin 16 connects to the suction of a pump 42. The pump 42 discharge in conduit 43 can be directed through conduits 44, 47 and/or 50. Conduit 44 is directed back to the pump 42 suction. Conduit 50 directs flow to the flush header 60 in the basin 16. Conduit 47 directs flow out of the system. Flow in conduit 44 from the pump 42 directed back to the pump 42 suction is controlled by pressure controller 45 which senses conduit 44 pressure and adjusts valve 46. If valves 48 and 51 are closed and there is no flow in conduits 47 and 50, valve 46 is opened by the pressure controller 45. Then, all of the pump discharge 43 is directed back to the pump suction by conduit 44. Sensing devices 52 are located in the basin effluent line 55. These devices measure conductivity, pH, turbidity, etc. quality of the cooled water 19 leaving the basin 16. They indicate when solids, etc. need to be purged from the basin 16. A signal from the sensing devices 52 is directed to a controller 53 whose output can be directed to a controller 49 on conduit 47. Controller 49 output adjusts valve 48. Valve 48 determines the amount of fluid and particulate matter withdrawn from the removal header 47 and discharged from the cooling tower system 11 via conduit 47. Controller 49 output can also be directed to controller 56 which adjusts valve 51. This determines the amount of flow to the flush header 60 in the basin 16. This flow is increased when more agitation of settled solids in the basin 16 is desired. If the sensing device 52 measures satisfactory quality cooled water 19, then controller 53 calls for no effluent flow in conduit 47. Controller 49 closes valve 48, and controller 53 closes valve 51. The pump 42 discharge pressure controller 45 will sense high pressure and will open valve 46. No material is withdrawn from the removal header 41 and no material is pumped through the flush header 60. Also controller 53 can call for pump 42 to be shut down, if the controller 53 is linked to other devices such as a solenoid or a relay network (not shown). However, if the sensing device 52 measures unsatisfactory quality cooled water 19, then controller 53 calls for flow in conduit 47 and directs that pump 42 be turned on if it is off. The measuring device and controller now sense that solids, etc. must be purged from the system. Some fluid and some particulate matter are removed from the basin 16 of the cooling system 11 when controller 49 opens valve 48 to some desired percentage. Controller 53 opens valve 51 in order to direct flow to the flush header 60. Flow in the flush header 60 sweeps the basin 16 and agitates particulate matter so that such can be withdrawn by the removal header 41. With flows in conduits 47 and 50, the pressure controller 45 will close valve 46 to maintain the desired discharge pressure of pump 42. Various control parameters or schemes may be used with or substituted for those shown. For instance, controllers 49 and 50 are shown as flow controllers; controller 53 output could be directed to valves 48 and 51 with a ratio controller determining the relative positions in lieu of separate controllers 49 and 50. Also, flow in conduit 53 could be set at a desired constant level. This would allow a constant recirculating flush or flow along the basin 16 bottom. This flow would continuously agitate solids in the basin 16 and prevent their settling out.

While the invention has been described in conjunction with presently preferred embodiments, it is obviously not limited thereto. Reasonable variations and modifications which will become apparent to those skilled in the art can be made in this invention without departing from the spirit and scope thereof.

That which is claimed is:

1. A method for removing substances in a cooling tower basin from the cooling tower basin comprising:

(a) passing an aqueous flush fluid into the cooling tower basin through a perforated flush tube means which extends into the cooling tower basin, (b) agitating and mixing substances in the cooling tower basin with the aqueous flush fluid of (a), (c) withdrawing substances in the cooling tower basin and the aqueous flush fluid of (a) from the cooling tower basin, using a separate perforated removal tube means which extends into the basin.

2. A process in accordance with claim 1 wherein said substances in the cooling tower basin to be removed are water insoluble solids.

3. A process in accordance with claim 1 wherein said substances in the cooling tower basin to be removed are polymeric solids.

4. A method to control the buildup of solids in a cooling tower basin comprising:

(a) measuring a parameter of the effluent cooled water downstream from the cooling tower basin, (b) feeding an aqueous flush fluid into a perforated flush tube located in the cooling tower basin, (c) agitating and mixing the cooled water and solids in the cooling tower basin by the introduction of said aqueous flush fluid into said basin, (d) withdrawing a mixture of cooled water, solids, and aqueous flush fluid from the cooling tower basin via a perforated removal header until the parameter of (a) is at or near a desired level.

5. A method in accordance with claim 4 wherein the parameter of the effluent cooled water is pH.

6. A method in accordance with claim 4 wherein the parameter of the effluent cooled water is turbidity.

7. A method in accordance with claim 4 wherein the parameter of the effluent cooled water is conductivity.

8. A method to control the buildup of solids in a cooling tower basin comprising:

(a) measuring a parameter of the effluent cooled water downstream from the cooling tower basin, (b) feeding an aqueous flush fluid into a perforated flush tube located in the cooling tower basin, (c) agitating and mixing the cooled water and solids in the cooling tower basin by the introduction of said aqueous flush fluid into said basin, (d) withdrawing a mixture of cooled water, solids, and aqueous flush fluid from the cooling tower basin via a perforated removal header until the parameter of (a) is at or near a desired level, (e) recycling a portion of the mixture of cooled water, solids, and aqueous flush fluid withdrawn from the cooling tower basin to the cooling tower basin as aqueous flush fluid.

9. A method in accordance with claim 4 or 8 wherein the measurement of the parameter of effluent cooled water is directed to an automatic controller which controls the amount of aqueous flush fluid fed into the cooling tower basin and the amount of the mixture of cooled water, solids and aqueous flush fluid withdrawn from the system.

10. An apparatus for adding an aqueous flush fluid to a cooling tower basin having a floor comprising:

(a) a perforated tube means positioned near the floor of the cooling tower basin, having a plurality of apertures which can pass a flow of said aqueous flush fluid, (b) a source of pressurized aqueous flush fluid, (c) a means for connecting said source of pressurized aqueous flush fluid in communication with the perforated tube means, (d) a fluid withdrawal conduit, (e) switch means operatively connected to said perforated tube means and permitting fluid communication between said perforated tube means and said source of pressurized aqueous flush liquid or said fluid withdrawal conduit, (f) controller means for operating said switch means such as to control the time said flush fluid is passed into said basin and the time a fluid is withdrawn from said basin.

11. An apparatus in accordance with claim 13 wherein said apertures are fitted with nozzles which direct a flow of aqueous flush fluid in a desired direction.

* * * * *

UNITED STATES PATENT AND TRADEMARK OFFICE

CERTIFICATE OF CORRECTION

PATENT NO. : 4,427,553

DATED : January 24, 1984

INVENTOR(S) : Sharon R. Fore

It is certified that error appears in the above-identified patent and that said Letters Patent is hereby corrected as shown below:

Column 8, Claim 11, line 18, "13" should be --- 10 ---.

Signed and Sealed this

*Twenty-sixth* Day of *June 1984*

[SEAL]

*Attest:*

GERALD J. MOSSINGHOFF

*Attesting Officer*

*Commissioner of Patents and Trademarks*